US009758736B2

(12) United States Patent
Granados

(10) Patent No.: US 9,758,736 B2
(45) Date of Patent: Sep. 12, 2017

(54) STEAM INJECTOR FOR A GASIFICATION SYSTEM

(71) Applicant: General Electric Company, Schenectady, NY (US)

(72) Inventor: Luis Rogelio Granados, Houston, TX (US)

(73) Assignee: General Electric Company, Schenectady, NY (US)

( * ) Notice: Subject to any disclaimer, the term of this patent is extended or adjusted under 35 U.S.C. 154(b) by 190 days.

(21) Appl. No.: 14/633,354

(22) Filed: Feb. 27, 2015

(65) Prior Publication Data

US 2016/0251585 A1 Sep. 1, 2016

(51) Int. Cl.

| | |
|---|---|
| ***C10J 3/00*** | (2006.01) |
| ***B01F 5/00*** | (2006.01) |
| ***C10J 3/50*** | (2006.01) |
| *B01F 5/06* | (2006.01) |

(52) U.S. Cl.

CPC ..... *C10J 3/506* (2013.01); *C10J 3/503* (2013.01); *B01F 5/0615* (2013.01); *B01F 2005/0636* (2013.01); *C10J 2200/09* (2013.01); *C10J 2200/152* (2013.01); *C10J 2300/0976* (2013.01)

(58) Field of Classification Search

CPC ..... B01F 5/04; B01F 5/045; B01F 5/0451

See application file for complete search history.

(56) References Cited

U.S. PATENT DOCUMENTS

| | | | | |
|---|---|---|---|---|
| 3,984,504 | A * | 10/1976 | Pick | F16L 55/045 122/442 |
| 4,341,530 | A | 7/1982 | Loth et al. | |
| 4,473,512 | A * | 9/1984 | Pick | F28C 3/06 122/442 |
| 4,624,684 | A | 11/1986 | Stevenson | |
| 4,919,541 | A | 4/1990 | Grosz-Roell et al. | |
| 5,525,242 | A * | 6/1996 | Kerecz | B01F 3/04099 210/220 |
| 6,082,713 | A * | 7/2000 | King | B01F 5/0451 261/79.2 |
| 6,526,758 | B2 | 3/2003 | Ranasinghe et al. | |
| 8,342,486 | B2 | 1/2013 | Smith | |
| 2009/0065957 | A1 * | 3/2009 | Mao | B01F 3/04049 261/78.1 |

* cited by examiner

*Primary Examiner* — Matthew Merkling

(74) *Attorney, Agent, or Firm* — Fletcher Yoder, P.C.

(57) ABSTRACT

A system includes a first steam injector configured to mix a steam and a feedstock to form a heated feedstock. Additionally, first viscosity of the feedstock is greater than a second viscosity of the heated feedstock. The system also includes a feed system positioned upstream of the first steam injector and configured to supply the feedstock to the first steam injector. In addition, the system includes a steam system configured to supply the steam to the first steam injector. Furthermore, the system includes a gasifier coupled to the first steam injector and configured to receive the heated feedstock.

12 Claims, 4 Drawing Sheets

STEAM INJECTOR FOR A GASIFICATION SYSTEM

BACKGROUND

The subject matter disclosed herein relates to gasification systems and, more particularly, to a steam injector that may be utilized to improve the efficiency of the gasification system.

Gasifiers convert carbonaceous materials into a gaseous mixture consisting primarily of carbon monoxide and hydrogen, referred to as synthesis gas or syngas. For example, a gasification system may include one or more gasifiers that react a feedstock at a high temperature with oxygen and water or steam to produce syngas. The syngas may be used for power generation, chemical production, or any other suitable application. Prior to use, the syngas may be cooled in a syngas cooler and treated in a gas treatment system.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a first steam injector configured to mix a steam and a feedstock to form a heated feedstock. Additionally, first viscosity of the feedstock is greater than a second viscosity of the heated feedstock. The system also includes a feed system positioned upstream of the first steam injector and configured to supply the feedstock to the first steam injector. In addition, the system includes a steam system configured to supply the steam to the first steam injector. Furthermore, the system includes a gasifier coupled to the first steam injector and configured to receive the heated feedstock.

In a second embodiment, a steam injector includes a body comprising a first axial end, a second axial end, and a body axis extending between the first axial end and the second axial end. The steam injector also includes a feed inlet at the first axial end configured to receive a feedstock. Additionally, the steam injector includes a steam inlet positioned between the first axial end and the second axial end. The steam inlet is configured to receive steam. Also, the steam injector includes a feed outlet at the second axial end configured to direct a heated feedstock out of the body. Furthermore, the steam injector includes a mixing feature disposed in the body and configured to induce rotation of the feedstock and to mix the steam with the feedstock to form the heated feedstock as the feedstock flows axially through the body.

In a third embodiment, a system includes a steam injector configured to mix a steam flow with a feedstock to increase a temperature of the feedstock. The steam injector comprises a mixing feature configured to induce rotation of the feedstock to facilitate mixing the steam flow with the feedstock.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As discussed in detail below, the disclosed embodiments include a steam injector positioned between a feed system and a gasifier. The steam injector is configured to inject steam into a feedstock flow before the feedstock reaches the gasifier to increase the temperature of the feedstock. In certain embodiments, as the temperature of the feedstock increases, the viscosity of the feedstock decreases. As a result, feedstock with a lower viscosity may enable an increased throughput and/or a reduced load on associated equipment. The steam injector may include a mixing feature configured to induce rotation of the feedstock to uniformly mix the steam and the feedstock within the steam injector. For example, the mixing feature may include helical projections extending radially into the steam injector to interact with the feedstock and facilitate mixing between the feedstock and the steam. As a result, the temperature of the feedstock may be uniformly increased.

Figure 1:
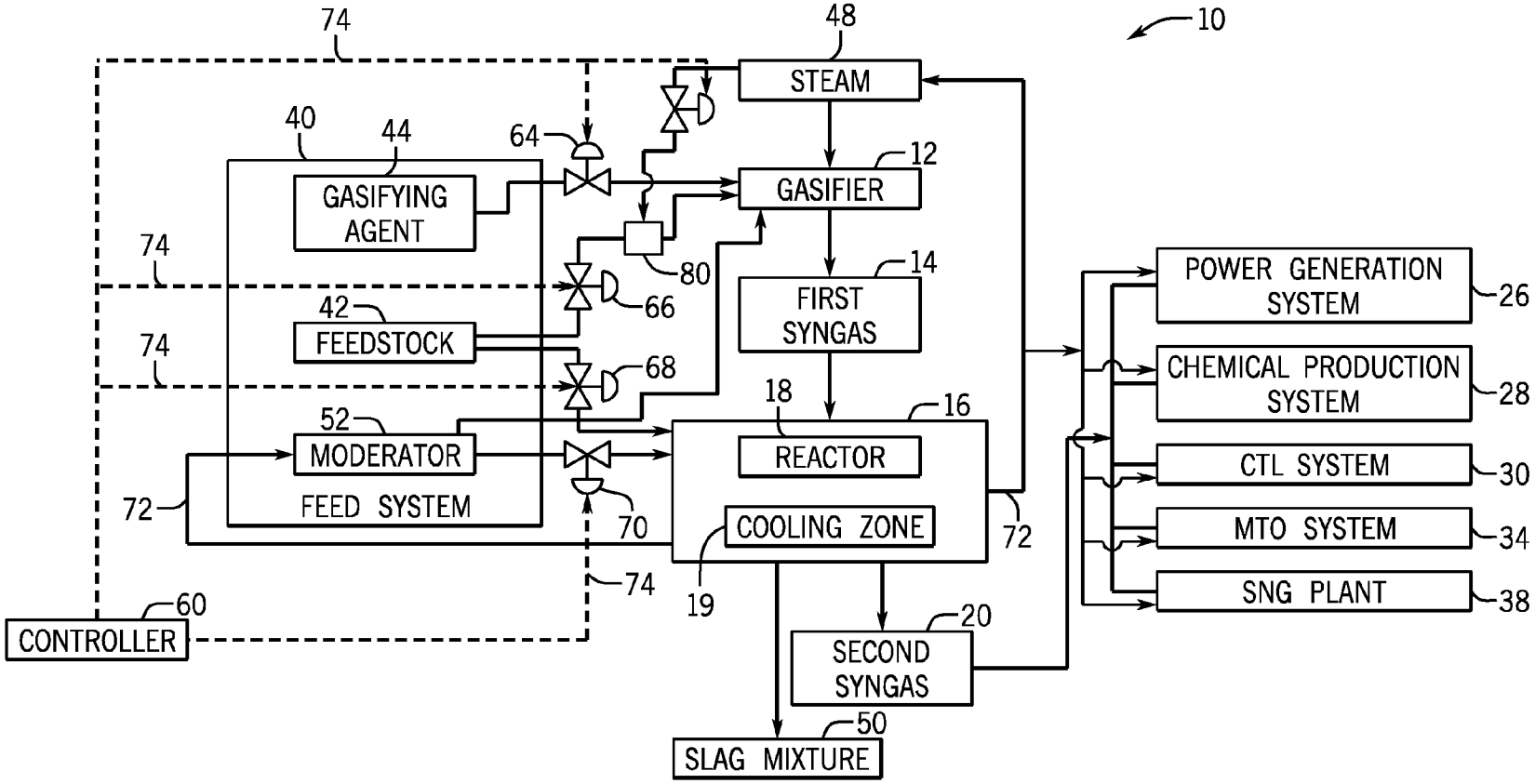
FIG. 1 is a block diagram of an embodiment of a gasification system including a gasifier configured to generate a first syngas and an integrated reactor-syngas cooler configured to generate a second syngas.

FIG. 1 illustrates an embodiment of a gasification system 10 including a gasifier 12 that generates a first syngas 14 and an integrated reactor-syngas cooler 16 (e.g., a syngas cooler with a reactor or reaction zone and a cooler or cooling zone in a single housing) including an integrated reactor-syngas cooler reactor 18 configured to generate a second syngas 20 (e.g., CO, $H_2$, methane, synthetic natural gas (SNG)) for use in one or more downstream applications, and an integrated reactor-syngas cooler cooling zone 19 configured to absorb heat from syngas 20, such as in the form of steam (e.g., steam 72). For example, the second syngas 20 and at least a portion of the steam 72 may be used to operate a power generation system 26, a chemical production system 28, a coal-to-liquids (CTL) system 30, a methanol-to-olefin chemical system (MTO) 34, a synthetic natural gas chemical plant (SNG) 38, and/or other suitable systems or applications.

As illustrated, the gasifier 12 receives reactants from a feed system 40. The feed system 40 supplies a feedstock 42 and a gasifying agent 44 (e.g., air, oxygen, oxidant, etc.) to the gasifier 12. The feedstock 42 is utilized as a source of energy for the gasification system 10. The feedstock 42 may include coal, petroleum coke, biomass, wood-based materials, agricultural wastes, tars, asphalt, heavy residues from a refinery, or other carbon containing items. Prior to gasification, the feedstock 42 may be resized or reshaped in the feed system 40 by chopping, milling, shredding, pulverizing, briquetting, or pelletizing the feedstock 42. Additionally, water, or other suitable liquids may be added to the feedstock 42 to create slurry-type feedstock.

Additionally, the gasifier 12 includes a reactor or a reaction chamber disposed in a gasification vessel to enable gasification of the feedstock 42 to produce the first syngas 14. The gasifier 12 may convert the feedstock 42 into the syngas 14 (e.g., a combination of carbon monoxide (CO) and hydrogen ($H_2$)). This conversion may be accomplished by subjecting the feedstock 42 to controlled amounts of gasifying agent 44 (e.g., pure oxygen, air, or a mixture thereof) and steam 48 or moderator 52 (e.g., steam, water or carbon dioxide) at elevated pressures, e.g., from approximately 2 MPa to 8.5 MPa, and temperatures, e.g., approximately 1100 degrees Celsius (C) to 1600 degrees C., depending on the type of gasifier 12 utilized. The gasifier 12 may be an entrained-flow gasifier, such as an updraft or downdraft entrained flow gasifier. Alternatively, in some embodiments, gasifier 12 may be a fluidized-bed gasifier, such as a bubbling fluidized-bed gasifier or a circulating fluidized-bed gasifier. Also, although feedstock 42 and moderator 52 are depicted separately in FIG. 1, in many cases, the slurry liquid (e.g., the slurry-type feedstock) and/or the pressurization and/or carrier gas (e.g., in the dry-type feedstock) may be one and the same as moderator 52.

The actual gasification process reactions may be viewed as occurring in different steps. For example, during the gasification process, the feedstock 42 may first undergo a pyrolysis process, whereby the feedstock 42 is heated, yielding a combination of volatiles and char. The volatiles generated during the pyrolysis process, also known as devolatilization, may be partially combusted by reaction with gasifying agent 44. The volatiles may react with the gasifying agent 44 to form carbon dioxide ($CO_2$) and CO in partial combustion reactions, which provide heat for the subsequent gasification reactions. Char generated during the devolatilization may react with the $CO_2$ and steam to produce CO and $H_2$. In essence, the gasifier 12 utilizes steam 48 and the gasifying agent 44 to partially oxidize some of the feedstock 42 to produce CO and release energy, which drives additional reactions, including converting further feedstock 42 to $H_2$ and additional $CO_2$ via a reaction known as the water-gas-shift reaction.

In this way, the gasifier 12 manufactures a resultant gas (e.g., the syngas 14). This resultant gas may include as much as 85% of CO and $H_2$ in equal proportions, as well as $CO_2$, $H_2O$, $CH_4$, HCl, HF, COS, $NH_3$, HCN, and $H_2S$. This resultant gas may be termed untreated syngas, because it includes undesirable byproducts, for example, $H_2S$ and COS. The gasifier 12 may also generate waste that, depending on the type of gasifier and the feedstock used, may be comprised of a slag/particulate mixture 50. As should be noted, the slag/particulate mixture 50 may include slag, fine ash, and char, at least a portion of which may be a wet ash material. This slag/particulate mixture 50 may be at least partially cooled and removed from the syngas 14 during cooling of the untreated syngas in the integrated reactor-syngas cooler 16 and/or downstream. Further, it is during this cooling and subsequent process steps prior to discharge from system 10 that most of any wet ash material is likely to be converted to dry ash material.

The integrated reactor-syngas cooler 16 may include features that may facilitate the augmentation and/or further reduction (e.g., methanation) of the syngas 14. For example, the integrated reactor-syngas cooler 16 may be configured to receive additional feedstock (e.g., feedstock 42). The additional feedstock may absorb heat from the first syngas 14 in the integrated reactor-syngas cooler reactor 18 and undergo a methanation reaction, thereby generating methane (e.g., the second syngas 20). In certain embodiments, the integrated reactor-syngas cooler reactor 18 may be supplied with a moderator 52 (e.g., steam) to facilitate the further conversion of feedstock, and production of methane (e.g., the second syngas 20), or may also receive in addition to or alternatively a reactive gas, such as $CO_2$, that may react with first syngas 14 and second feedstock 42 to increase the yield of second syngas 20. Additionally, the integrated reactor-syngas cooler 16 may include features that may facilitate cooling of the second syngas 20 as it flows through the integrated reactor-syngas cooler 16. For example, the integrated reactor-syngas cooler 16 may include cooling tubes (e.g., a heat exchanger) in a downstream cooling portion of the integrated reactor-syngas cooler 16 (e.g., cooling zone 19) that may cool the second syngas 20 via indirect heat transfer with a coolant flowing through the cooling tubes. Moreover, the integrated reactor-syngas cooler 16 may be useful for separating particulates, e.g., the slag/particulate mixture 50 from the gasifier, as well as any additional particulates produced that add to slag/particulate mixture 50 as a result of the reaction of the additional feedstock introduced into integrated reactor-syngas cooler reactor 18 that may be mixed with the first and second syngas 14 and 20, respectively, prior to transmission of the second syngas 20 to the corresponding system (e.g., the power generation system 26, chemical production system 28, CTL system 30, MTO system 34, and/or SNG plant 38). As should be noted, the second syngas 20 may undergo additional processing (e.g., scrubbing, purification, etc.) downstream of the integrated reactor-syngas cooler 16 before use.

The gasification system 10 may also include a controller 60 (e.g., an electronic and/or processor-based controller) to govern operation of the gasification system 10. The controller 60 may independently control operation of the gasification system 10 by electrically communicating with sensors, control valves (e.g., valves 64, 66, 68, and 70), and pumps, or other flow adjusting features throughout the gasification system 10. The controller 60 may include a distributed control system (DCS) or any computer-based workstation that is fully or partially automated. For example, the controller 60 can be any device employing a general purpose or an application-specific processor, both of which may generally include memory circuitry for storing instructions such as gasification parameters (e.g., the gasification conditions of the feedstock 42). The processor may include one or more processing devices, and the memory circuitry may include one or more tangible, non-transitory, machine-readable media collectively storing instructions executable by the processor.

In one embodiment, during operation of the gasification system 10, the controller 60 may operate flow control devices (e.g., valves, pumps, etc.) to control amounts and/or flows between the different system components. For example, the controller 60 may control valves 66 and 68 to adjust amounts of feedstock 42 supplied to the gasifier 12 and the integrated reactor-syngas cooler reactor 18, respectively. Similarly, the controller 60 may control the valves 64 and 70 to adjust amounts of the gasifying agent 44 to gasifier 12 and the moderator 52 to integrated reactor-syngas cooler reactor 18, respectively. In this way, gasification reactions (e.g., water gas, water-gas-shift, and methanation reactions) within the gasifier 12 and the integrated reactor-syngas cooler reactor 18 may be controlled by the controller 60. Accordingly, the composition of the first syngas 14, generated in the gasifier 12, and the second syngas 20, generated in the integrated reactor-syngas cooler reactor 18, may be adjusted, as described in further detail below. It should be noted that there may be additional valves throughout the gasification system 10 used to adjust different amounts and/or flows between the system components. For example, valves similar to valve 70 may be used to control the flow of steam 48 and moderator 52 to gasifier 12. Furthermore, other devices may be used for controlling flow rates of certain streams, including positive displacement pumps and other such metering devices without departing from the scope of the invention.

During startup of the gasification system 10, the controller 60 may execute a startup control module to control a flow of the gasifying agent 44, the feedstock 42, the moderator 52, and, when available, steam 48 supplied to the gasifier 12. In addition, during steady-state operation of the gasification system 10, the controller 60 may execute a steady-state control module to control a flow of the feedstock 42 and the moderator 52 to the integrated reactor-syngas cooler reactor 18, and flows of steam 48 and steam 72 generated in the integrated reactor-syngas cooler 16 to gasifier 12, integrated reactor-syngas cooler reactor 18, and/or other associated systems (e.g., systems 26, 28, 30, 34 and 36), processes and equipment. The controller 60 may use the startup and steady-state control modules to control operations differently during startup and steady-state. For example, during startup, the controller 60 may flow a first amount of the feedstock 42, the gasifying agent 44, and/or the moderator 52 into the gasifier 12 such that the first syngas 14 has a $CO/H_2$ ratio that facilitates generation of a desired composition of the second syngas 20 (e.g., $H_2$ or $CH_4$ enriched). During steady-state operation, the controller 60 may gradually adjust a second amount of the feedstock 42, the gasifying agent 44, the steam 48, and/or the moderator 52 flowing through the gasifier 12 and/or the integrated reactor-syngas cooler reactor 18 to maintain or adjust the composition of the second syngas 20. For example, during startup of the gasification system 10, increased steam generation may be desired. As such, the controller 60 may send a higher flow of the feedstock 42 to the gasifier 12 and a reduced flow of the feedstock 42 to the integrated reactor-syngas cooler 16 by controlling the valves 66 and 68. Controller 60 may then gradually decrease a flow of the feedstock 42 to the gasifier 12 and gradually increase a flow feedstock 42 to the integrated reactor-syngas cooler 16 to approach steady-state conditions, while simultaneously adjusting the flows of gasifying agent 44, steam 48 and moderator 52. In this way, the flow of the feedstock 42 and other feeds may be gradually balanced, or otherwise adjusted, between the gasifier 12 and the integrated reactor-syngas cooler 16 over time to achieve a desired set of operating conditions. In addition, during steady state operation, the controller 60 may also optimize a composition of the syngas (e.g., the first syngas 14 and/or the second syngas 20) to a rate of steam generation according to an end-use (e.g., the power generation, chemical production, coal-to-liquid process, and/or synthetic natural gas) of the second syngas 20 by controlling the valves 66 and 68 and setting the flow of the feedstock 42 at a desired rate. In certain embodiments, the controller 60 may control flow devices that may be part of a weighing mechanism that measures the amount of the feedstock 42, before it enters the gasifier 12 and/or the integrated reactor-syngas cooler reactor 18. In certain embodiments, the controller 60 may use information provided via input signals to execute instructions or code contained on a machine-readable or computer-readable storage medium and generate one or more output signals 74 to the various flow control devices (e.g., valves 64, 66, 68, and 70) to control a flow of fluids within the gasification system 10, for example, the gasifying agent 44, the feedstock 42, and the moderator 52.

As should be appreciated, the controller 60 may control the flow of the gasification components (e.g., the feedstock 42, the gasifying agent 44, steam 48, and the moderator 52) via any other suitable methods. For example, in embodiments where the feedstock 42 is a slurry feed, a metering pump may be used. The metering pump may be operated on a speed or a flow control instead of using a flow control valve to regulate the flow of the slurry feed.

In the illustrated embodiment, a steam injector 80 is positioned between the valve 66 and the gasifier 12. As will be described in detail below, the steam injector 80 mixes the steam 48 (e.g., saturated steam, superheated steam) with the feedstock 42 to increase the temperature of the feedstock 42, thereby decreasing the viscosity of the feedstock 42. The steam injector 80 may be directly coupled to the gasifier 12 (e.g., positioned directly upstream of the gasifier 12 without intervening feed lines or take offs, coupled directly to an inlet nozzle of the gasifier 12). As a result, the feedstock 42 may be pre-heated before entering the gasifier 12, thereby improving the efficiency of the gasification system 10.

Figure 2:
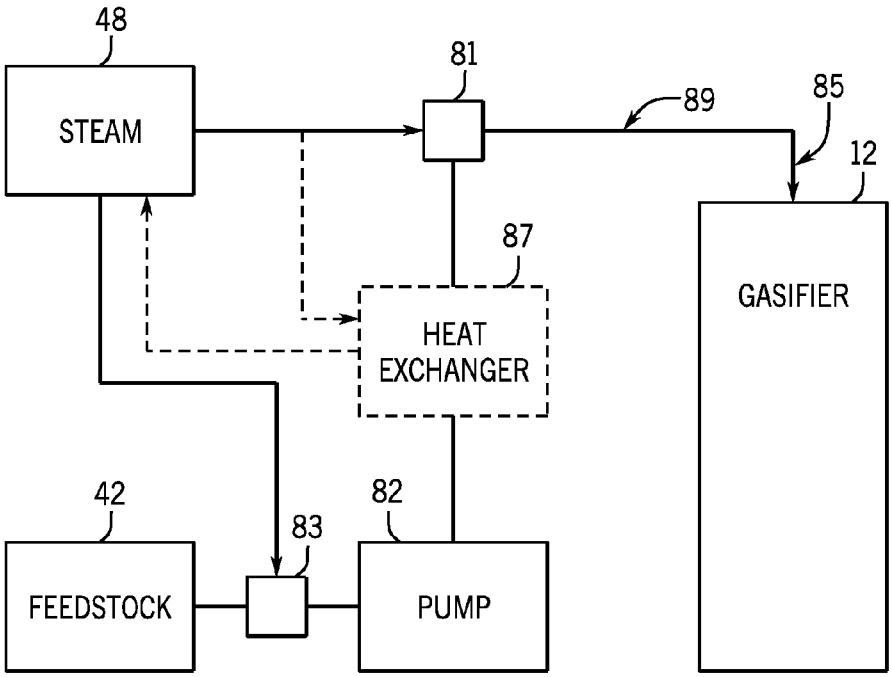
FIG. 2 is a block diagram of an embodiment of a gasification system including a steam injector.

FIG. 2 is a block diagram of an embodiment of the gasification system 10 including the steam injector 80. It is noted that the block diagram is simplified to focus on the steam injector 80. In some embodiments, the gasification system 10 has one or more steam injectors 80 (e.g., a first steam injector 81, a second steam injector 83). As described above, the feedstock 42 may be injected into the gasifier 12 via the feed system 40. In the illustrated embodiment, a pump 82 is configured to supply energy to the feedstock 42 to inject the feedstock 42 into the gasifier 12. For example, the pump 82 may be a positive displacement pump (e.g., rotary, reciprocating, screw, plunger, etc.), an impulse pump, a velocity pump, or the like. Additionally, in certain embodiments, an inlet nozzle 85 of the gasifier 12 may be raised above ground level and directly coupled to the first steam injector 81. That is, the first steam injector 81 may be coupled to the inlet nozzle 85 without intervening piping or components. The energy from the pump 82 enables the feedstock 42 to enter the gasifier 12 with sufficient pressure to overcome the internal pressure of the gasifier 12.

In the illustrated embodiment, the first steam injector 81 facilitates mixing the steam 48 with the feedstock 42 before the feedstock 42 enters the gasifier 12. As described above, in certain embodiments, the feedstock 42 may be a slurry mixture of liquid (e.g., water) and fuel (e.g., coal) when the feedstock 42 is injected into the gasifier 12. Accordingly, the viscosity of the feedstock 42 as a slurry mixture may be increased due to the solid fuel incorporated into the liquid, thereby increasing the load on the pump 82. Moreover, higher viscosities may increase wear on associated components (e.g., due to friction). Additionally, the increased viscosity of the feedstock 42 may also decrease the throughput of the gasification system 10 because a smaller amount of feedstock 42 may be directed to the gasifier 12 due to the high viscosity utilizing a greater amount of energy to travel through associated piping components to the gasifier 12.

In certain embodiments, increasing the temperature of the feedstock 42 may decrease the viscosity of the feedstock 42. For example, a heat exchanger 87 (e.g., shell and tube, plate and frame, etc.) may be positioned between the pump 82 and the gasifier 12 to increase the temperature of the feedstock 42 via indirect heating. The heat exchanger may utilize steam or waste gas to increase the temperature of the feedstock 42, thereby decreasing the viscosity of the feedstock 42 and potentially increasing the throughput of the gasification system 10. However, heat exchangers may be expensive and undergo frequent maintenance. For example, heat exchangers may be cleaned periodically due to wear and/or fouling caused by the feedstock 42 directed through the heat exchanger. Cleaning the heat exchangers may result in system downtime to take the heat exchanger off line and perform maintenance. Therefore, a passive, low maintenance system to increase the temperature of the feedstock 42 is desirable.

As discussed above, the viscosity of the feedstock 42 may have an inverse relationship with the temperature of the feedstock 42. That is, as the temperature of the feedstock 42 increases, the viscosity may decrease, thereby enabling flow of the feedstock 42 while utilizing less energy or enabling an increased throughput of the feedstock 42. For example, in certain embodiments, doubling the temperature of the feedstock 42 may decrease the viscosity of the feedstock 42 by an order of magnitude, or more. In certain embodiments, an increase of approximately twenty percent to the temperature of the feedstock 42 may decrease the viscosity of the feedstock 42 by several orders of magnitude. For example, in the illustrated embodiment, the feedstock 42 may have a first temperature of approximately 15 degrees C. and a first viscosity of approximately 1000 centipoise (cP). However, by increasing the temperature of the feedstock 42 to a second temperature of approximately 50 degrees C., a second viscosity may be approximately 60 cP. It should be appreciated that in other embodiments, the first temperature of the feedstock 42 may be approximately 5 degrees C., approximately 10 degrees C., approximately 20 degrees C., 2 approximately 5 degrees C., or any other suitable temperature. Moreover, in certain embodiments, the second temperature of the feedstock 42 may be approximately 55 degrees C., approximately 60 degrees C., approximately 65 degrees C., approximately 70 degrees C., or any other suitable temperature. As a result, the efficiency of the gasification system 10 may be increased because of the larger throughput into the gasifier 12.

As mentioned above, the one or more steam injectors 80 may be utilized to incorporate steam 48 into the feedstock 42, thereby increasing the temperature of the feedstock 42 and decreasing the viscosity of the feedstock 42. In some embodiments, the second steam injector 83 may be positioned upstream of the pump 82, or in any other suitable location to incorporate steam 48 into the feedstock 42. As will be described in detail below, the one or more steam injectors 80 may utilize saturated or superheated steam to increase the temperature of the feedstock 42 and form a heated feedstock 89 while maintaining a desired ratio of liquid to fuel.

Figure 3:
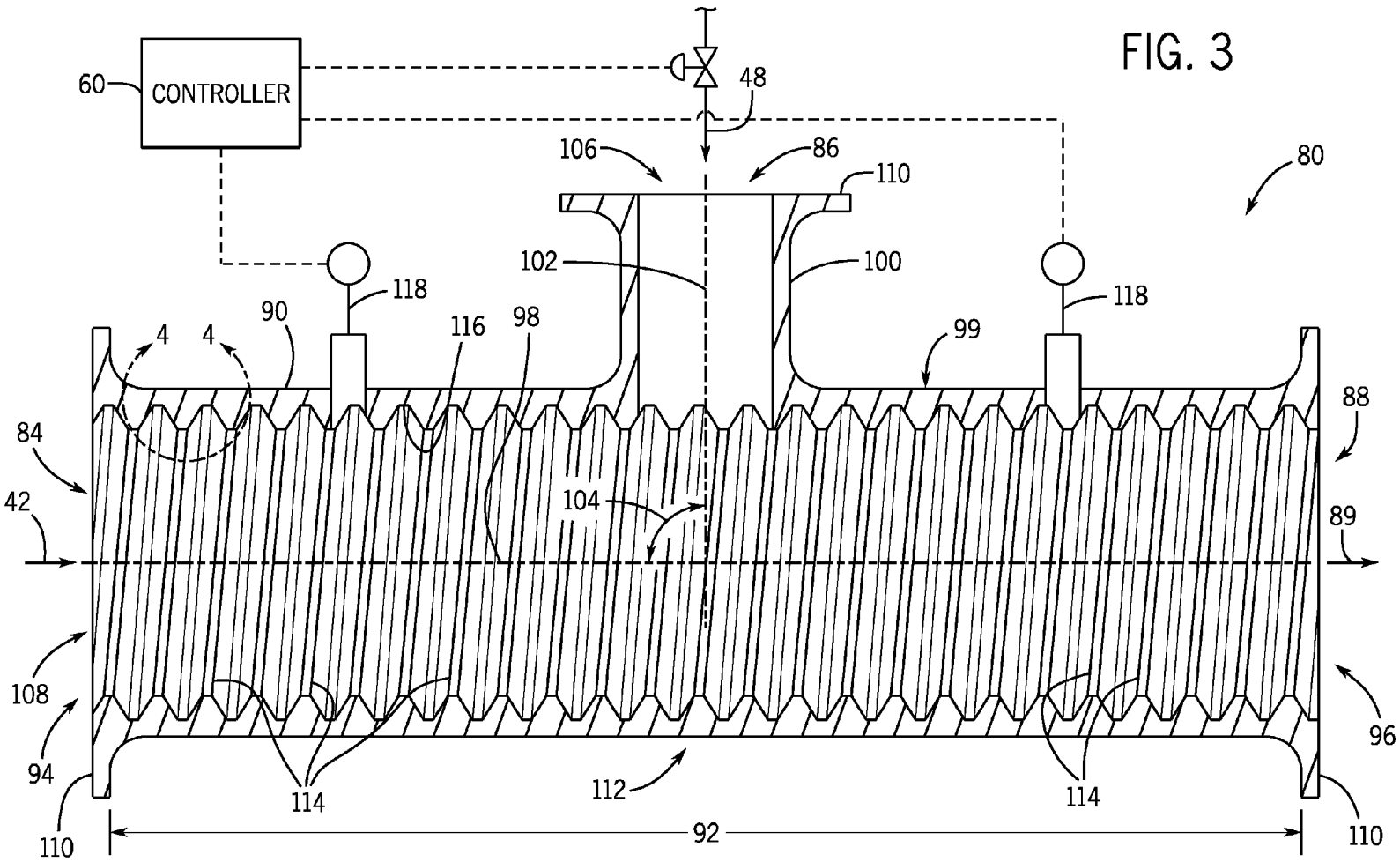
FIG. 3 is an axial cross-sectional view of an embodiment of the steam injector of FIG. 2.

FIG. 3 is an axial cross-sectional view of an embodiment of the steam injector 80. The steam injector 80 is configured to mix the steam 48 with the feedstock 42 to form the heated feedstock 89. As will be described below, the heated feedstock 89 has a higher temperature (e.g., a second temperature) than the temperature of the feedstock 42 (e.g., a first temperature). As a result, the heated feedstock 89 has a lower viscosity (e.g., a second viscosity) than the viscosity of the feedstock 42 (e.g., a first viscosity). As shown, a feed inlet 84 receives the feedstock 42 and a steam inlet 86 receives the steam 48. The steam 48 is configured to mix with the feedstock 42 to enable direct heating of the feedstock 42, as opposed to the indirect heating executed via a heat exchanger. As a result, less steam may be utilized to increase the temperature of the feedstock 42 to a desired temperature before the feedstock 42 leaves the steam injector 80 through a feed outlet 88. Additionally, the viscosity of the heated feedstock 49 may be less than the viscosity of the feedstock 42 by more than an order of magnitude. For example, as described below, the first viscosity of the feedstock 42 may be 1000 cP while the second viscosity of the heated feedstock 89 may be 60 cP.

The illustrated steam injector 80 includes a body 90 having a body length 92. The body 90 may be a tubular (e.g., pipe) having a standard wall thickness. However, in other embodiments, the body 90 may be different cross-sectional shapes, such as elliptical or polygonal, based on design conditions. Additionally, it will be appreciated that the body length 92 may be any suitable length based on design conditions and material properties. As shown, the feed inlet 84 is at a first axial end 94 and the feed outlet 88 is at a second axial end 96. Moreover, the body 90 includes a body axis 98 extending between the feed inlet 84 and the feed outlet 88. Additionally, a stub out 100 is positioned on the body 90 radially outward from the body axis 98. That is, the stub out 100 is coupled to an outer wall 99 of the body 90. In the illustrated embodiment, the stub out 96 includes a stub out axis 102 positioned substantially perpendicular (e.g., approximately 80 degree to 100 degrees) to the body axis 98 (e.g., transverse to the body axis 98). That is, an angle 104 between the body axis 98 and the stub out axis 102 is approximately 90 degrees. However, in other embodiments, the angle 104 between the stub out axis 102 and the body axis 98 may not be approximately 90 degrees. For example, the angle 104 may be 10 degrees, 20 degrees, 30 degrees, 40 degrees, 50 degrees, 60 degrees, 70 degrees, 80 degrees, or any other suitable angle to facilitate injection of the steam 48 into the body 90 for mixing with the feedstock 42. Moreover, in certain embodiments, the angle 104 may be particularly selected to reduce or eliminate the likelihood of impingement due to the injection of the steam 48. Accordingly, the stub out 100 is configured to direct the steam 48 into the body 90 to facilitate mixing of the steam 48 with the feedstock 42, and therefore increase the temperature of the feedstock 42.

In the illustrated embodiment, the stub out 100 is substantially centered between the first axial end 94 and the second axial send 94 of the body 90. However, in other embodiments, the stub out 100 may be located at other axial positions along the body length 92. In certain embodiments, the stub out 100 may be positioned one-eighth of the body length 92 from the first axial end 94, one-fourth of the body length 92 from the first axial end 94, three-fourths of the body length 92 from the first axial end 94, or any other suitable ratio of the body length 92 from the first axial end 94. For example, the stub out 100 may be closer to the first axial end 94. By positioning the stub out 100 closer to the first axial end 94, the steam 48 may be in the steam injector 80 for a longer period of time, thereby interacting with the feedstock 42 for a longer period of time before the feedstock 42 exits through the feed outlet 88. As a result, more mixing may occur and the temperature of the heated feedstock 89 may be higher. Furthermore, in other embodiments, the stub out 100 may be positioned closer to the second axial end 96. It is appreciated that the axial position of the stub out 100 may be particularly selected based on the operating conditions of the gasification system 10.

As mentioned above, the steam 48 is configured to mix with the feedstock 42 to increase the temperature of the feedstock 42 and, as a result, decrease the viscosity of the heated feedstock 89, compared to the feedstock 42, before the heated feedstock 89 is injected into the gasifier 12. As mentioned above, decreasing the viscosity of the heated feedstock 89 may increase throughput and also increase the efficiency of the gasification system 10 by pre-heating the feedstock 42 before injection. In certain embodiments, the feedstock 42 is a slurry mixture with a particularly selected ratio of liquid to fuel. Accordingly, the introduction of the steam 48 may be adjusted to substantially maintain the desired slurry ratio. For example, a cross-sectional area 106 of the steam inlet 86 may be smaller than a cross-sectional area 108 of the feed inlet 84 and the feed outlet 88. However, in other embodiments, the cross-sectional areas 108 of the feed inlet 84 and the feed outlet 88 may be smaller than or equal to the cross-sectional area 106 of the steam inlet 86. Moreover, in other embodiments, the cross-sectional areas 108 of the feed inlet 84 and the feed outlet 88 may not be equal. For example, the cross-sectional area 108 of the feed inlet 84 may be larger than the cross-sectional area 108 of the feed outlet 88.

In certain embodiments, the cross-sectional areas 106, 108 of the steam inlet 86, the feed inlet 84, and the feed outlet 88 may be particularly selected to adjust the amount of fluid (e.g., steam) added to the feedstock 42 before the feedstock 42 is introduced to the gasifier 12. For example, the steam to feedstock ratio may be 1:2, 1:3, 1:4, 2:1, 2:3, or any other suitable ratio based on the operating conditions of the gasification system 10. Additionally, in embodiments where superheated steam is used, a smaller quantity of steam may be utilized to heat the feedstock 42 to the desired temperature. For example, a target temperature of the heated feedstock 89 may be obtained with less superheated steam than saturated steam because the superheated steam may not increase the ratio of water added to the heated feedstock 89.

In the illustrated embodiment, the steam injector 80 has flanged connections 110 at the feed inlet 84, the steam inlet 86, and the feed outlet 88. The flanged connections 110 are configured to enable quick and efficient installation and removal of the steam injector 80 with the gasification system 10. For example, utilizing flanged connections 110 may enable off-site preparation of the steam injector 80 and reduce and/or substantially eliminate field welding during installation. Moreover, the flanged connections 110 and other components of the steam injector 80 may be manufactured according to international piping and pressure vessel codes (e.g., ASME B31.1, ASME B31.3, ASME B16.5, ASME Section 8 Div. 2, etc.). As a result, the steam injector 80 may couple to existing piping systems.

As mentioned above, the steam 48 mixes with the feedstock 42 in the steam injector 80 to increase the temperature of the feedstock 42 and to decrease the viscosity of the feedstock 42, thereby forming the heated feedstock 89. To facilitate mixing of the steam 48 with the feedstock 42, the steam injector 80 may include a mixing feature 112 positioned in the body 90. As will be described in detail below, the mixing feature 112 includes projections 114 to induce rotation and/or swirling of the feedstock 42. By inducing rotation and/or swirling of the feedstock 42, the mixing feature 112 may increase the mixing of the steam 48 with the feedstock 42. In certain embodiments, the mixing feature 112 may be a helical feature (e.g., screw shaped) where the projections 114 may be equated with the threads of a screw. In other words, the projections 114 interact with the flow of the feedstock 42 to induce rotation of the feedstock 42 and facilitate mixing and greater energy transfer from the steam 48 to the feedstock 42. In the illustrated embodiment, the mixing feature 112 is a continuous helical feature extending from the first axial end 94 to the second axial end 96. For example, as mentioned above, the mixing feature 112 may be generally screw shaped and extend axially along the body length 92. However, in other embodiments, the mixing feature 112 may not be a continuous feature. For example, different sections of the body 90 may include the mixing feature 112 while other sections do not. Additionally, in certain embodiments, the mixing feature 112 may include variations along different sections of the body 90. Moreover, as will be described below, the projections 114 extend radially inward from an interior surface 116 of the body 90. As such, the projections 114 may engage the feedstock 42 as the feedstock 42 enters the body 90 at the feed inlet 84 to induce rotation as the feedstock 42 moves axially through the body 90.

Additionally, in the illustrated embodiment, the steam injector 80 includes one or more gauges 118. The gauges 118 may be temperature gauges, pressure gauges, flow gauges, sample gauges, or the like to monitor operating conditions of the feedstock 42 at the feed inlet 84, and operating conditions of the heated feedstock 89 at the feed outlet 88. For example, the gauges 118 may monitor the temperature of the feedstock 42 at the feed inlet 84 and the feed outlet 88 to determine whether or not the steam 48 is heating the feedstock 42 to a desired value. In some embodiments, the gauges 118 may be communicatively coupled to the controller 60. For example, the controller 60 may receive a signal indicative of the feedstock temperature at the feed outlet 88 and determine that the temperature is less than a desired temperature (e.g., by evaluating the data against information stored in a memory of the controller 60). As a result, the controller 60 may send a signal to a valve to increase the steam flow to the steam injector 80 to increase the temperature of the heated feedstock 89 at the feed outlet 88. Accordingly, the controller 60 may be utilized to adjust the flow of the steam 48 and/or the feedstock 42 to the steam injector 80 based on operating conditions as determined by the one or more gauges 118. While the illustrated embodiment includes two gauges 118, in other embodiments there may be more or fewer gauges positioned on or within the body 90. Moreover, in certain embodiments the gauges 118 may not be positioned on the steam injector 80 and may be positioned at other locations in the gasification system 10.

Figure 4:
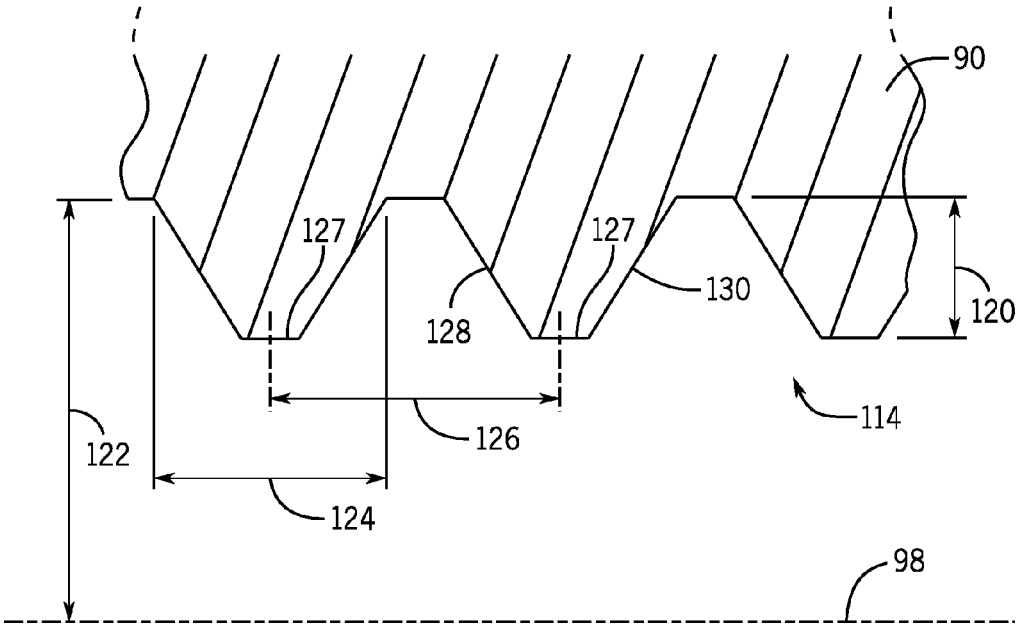
FIG. 4 is a partial axial cross-sectional view of an embodiment of a mixing feature of the steam injector of FIG. 2, taken along the line 4-4.

FIG. 4 is a partial axial cross-sectional view take along line 4-4 of an embodiment of the mixing feature 112 having projections 114 extending radially inward from the interior surface 116 of the body 90. As described above, in the illustrated embodiment, the mixing feature 112 may be a continuous helical feature extending axially along the body length 92. The projections 114 have a projection height 120 that extends radially inward toward the body axis 98. In certain embodiments, the projections 114 may extend radially inward approximately 10 percent of a radius 122 of the body 90. However, in other embodiments, the projections 114 may extend radially inward approximately 20 percent of the radius 122, approximately 30 percent of the radius 122, approximately 40 percent of the radius 122, approximately 50 percent of the radius 122, or any other suitable percentage of the radius 122. Additionally, the projection height 120 may include a range between 5 percent and 15 percent the radius 122, between 15 percent and 25 percent the radius 122, between 25 percent and 35 percent the radius 122, between 35 percent and 45 percent the radius 122, or any other suitable range. Furthermore, in other embodiments, the projection height 120 may be less than 20 percent the radius 122, less than 40 percent the radius 122, less than 60 percent the radius 122, or any other suitable range. While the illustrated embodiment includes projections 114 having equal projection heights 120, in other embodiments the projection heights 120 of the projections 114 may vary across the body length 92. For example, the projection heights 120 between alternating projections 114 may vary. Moreover, the projection height 120 may increase or decrease along the body length 92. Accordingly, various modifications to the mixing feature 112 may facilitate generating a vortex within the feedstock 42 to enable the steam 48 to interact with the feedstock 42, and thereby increase the temperature of the feedstock 42.

Additionally, the projections 114 have a projection width 124 that extends axially along the body axis 98. In other words, the projection width 124 may be defined as the width of the threads positioned on the interior surface 116 of the body. In certain embodiments, the projection width 124 is approximately 1/20 the body length 92. However, in other embodiments, the projection thickness 112 may be approximately 1/100 the body length 92, approximately 1/50 the body length 92, approximately 1/25 the body length 92, approximately 1/15 the body length 92, approximately 1/10 the body length 92, approximately 1/5 the body length 92, or any other suitable ratio of body length 92 based on the operating conditions of the gasification system 10 and the fluid properties of the feedstock 42. Additionally, in certain embodiments, individual projections 114 may have different projection widths 124 than adjacent projections 114. For example, alternating projections 114 may have different projection widths 124, thereby varying the flow of the feedstock 42 through the steam injector 80.

Furthermore, the projections 114 may be separated by a pitch 126. The pitch 126 is defined as the axial distance of a crest 127 of one projection 114 to another. In the illustrated embodiment, the pitch 126 is approximately 1/5 the body length 92. However, in other embodiments, the pitch 126 may be 1/10 the body length 92, 1/7 the body length 92, 1/2 the body length 92, 1/4 the body length 92, or any other suitable radio of the body length 92. It will be appreciated the pitch 126 may be adjusted to induce rotation of the feedstock 42 flowing through the steam injector 80. Moreover, in certain embodiments, the pitch 126 may not be equal across the body length 92. For example, the first half of the mixing feature 112 (e.g., a portion of the projections 114 upstream of the steam inlet 86) may have a different pitch 126 than the second half of the mixing feature 112 (e.g., a portion of the projections 114 downstream of the steam inlet 86). As will be appreciated, changing the pitch 126 may adjust the rotation of the feedstock 42 flowing through the steam injector 80. By adjusting the rotation before and after the injection of the steam 48, the mixing of the steam 48 and the feedstock 42 may be controlled to obtain substantially uniform heat distribution through the feedstock 42.

Moreover, in the illustrated embodiment, the projections 114 are generally V-shaped. However, in other embodiments, the projections 114 may be arcuate, sinusoidal, or any other shape that may induce rotation of the feedstock 42 as the feedstock 42 flows through the steam injector 80. Additionally, while the projections 114 are substantially symmetrical in the illustrated embodiment, in other embodiments the projections 114 may not be symmetrical. For example, a leading edge 128 of the projection may be at a more severe angle, relative to the body axis 98, than a trailing edge 130. Accordingly, the shape of the projections 114 may be particularly selected based on characteristics of the feedstock 42 or operating conditions of the gasification system 10.

Figure 5:
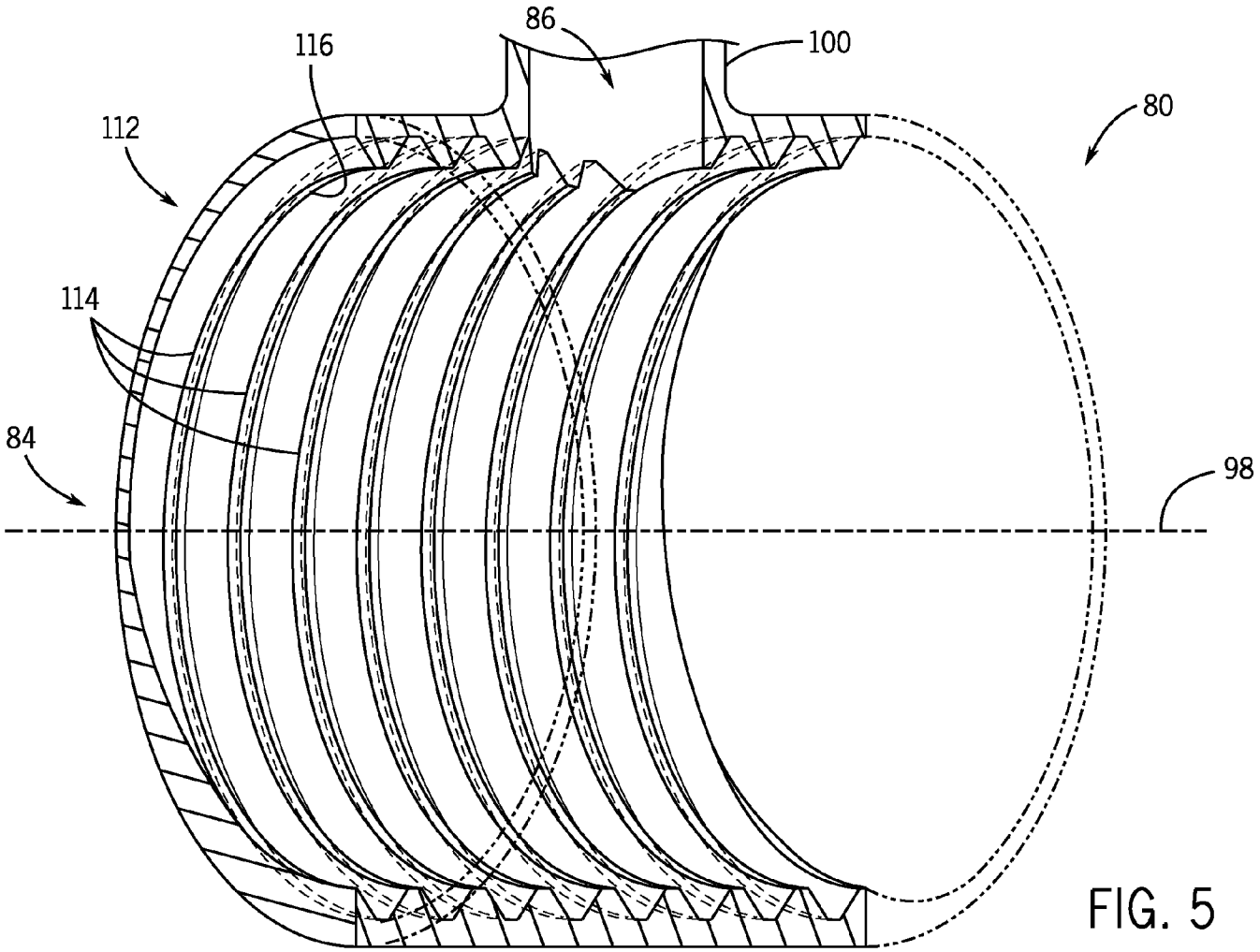
FIG. 5 is a partial perspective view of an embodiment of the steam injector of FIG. 2.

FIG. 5 is a partial perspective view of an embodiment of the steam injector 80. As described above, the mixing feature 112 extends axially along the body axis 98 from the first axial end 94 to the second axial end 96. Additionally, the projections 114 extend radially inward from the interior surface 116 to induce rotation of the feedstock 42 as the feedstock 42 flows axially through the steam injector 80 along the body axis 98. For example, as the feedstock 42 engages the projections 114, the flow direction of at least a portion of the feedstock 42 is changed such that at least the portion the feedstock 42 follows the helical pattern of the mixing feature 112. As a result, as the steam 48 enters the body 90, the steam 48 may be uniformly distributed through the feedstock 42 because of the revolving flow of the feedstock 42. Accordingly, the feedstock 42 may be evenly heated, thereby reducing the viscosity of the feedstock before the feedstock 42 enters the gasifier 12. As described above, by reducing the viscosity of the feedstock 42 the throughput of the gasification system 10 may be increased. Moreover, reducing the viscosity of the feedstock 42 may reduce erosion of downstream components (e.g., the gasifier injector), thereby increasing the working life of the gasification system 10. Furthermore, as described above, preheating the feedstock 42 may increase the efficiency of the gasifier 12.

As described above, the gasification system 10 may include the steam injector 80 between the gasifier 12 and the feed system 40 to increase the temperature of the feedstock 42, thereby decreasing the viscosity of the feedstock 42. In certain embodiments, the steam injector 80 includes the feed inlet 84 to receive the feedstock 42 and the steam inlet 86 to inject the steam 48 into the feedstock 42. The steam 48 and feedstock 42 mixture may exit the steam injector 80 through the feed outlet 88 for injection into the gasifier 12. The steam injector 80 includes the mixing feature 112 configured to enhance mixing between the feedstock 42 and the steam 48. For example, the mixing feature 112 may be a helical feature having projections 114 configured to induce rotation and/or swirling of the feedstock 42. As a result, the steam 48 may be evenly distributed through the feedstock 42, thereby providing a substantially uniform temperature increase in the feedstock 42. As a result, the throughput of the gasification system 10 may be increased.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A steam injector comprising:

a body comprising a first axial end, a second axial end, and a body axis extending between the first axial end and the second axial end;

a feed inlet at the first axial end configured to receive a feedstock along the body axis;

a stub out positioned between the first axial end and the second axial end, the stub out comprises a steam outlet coupled to the body, wherein the steam outlet is configured to direct steam toward the body axis;

a feed outlet at the second axial end configured to direct a heated feedstock out of the body along the body axis; and a mixing feature disposed in the body and configured to induce rotation of the feedstock and to mix the steam with the feedstock to form the heated feedstock as the feedstock flows axially through the body, wherein the steam mixes with the feedstock in a radially inward direction toward the body axis.

2. The steam injector of claim 1, the stub out positioned on an outer wall of the body, wherein the stub out comprises a steam inlet configured to receive the steam.

3. The steam injector of claim 2, wherein the stub out includes a stub out axis and the stub out axis is substantially perpendicular to the body axis.

4. The steam injector of claim 1, wherein the mixing feature is coupled to an interior surface of the body, is substantially helical, and extends from the first axial end to the second axial end.

5. The steam injector of claim 1, wherein the mixing feature comprises projections extending radially inward toward the body axis.

6. The steam injector of claim 1, comprising flanged connections at the feed inlet, steam inlet, and the feed outlet.

7. The steam injector of claim 1, comprising a first gauge positioned upstream of the steam inlet and a second gauge positioned downstream of the steam inlet, wherein the first and second gauges are configured to monitor a temperature differential between the feedstock and the heated feedstock.

8. A system comprising:

a steam injector configured to mix a steam flow with a feedstock to increase a temperature of the feedstock, wherein the feedstock flows along an axis of the steam injector, wherein the steam injector comprises a stub out coupled to the steam injector, the stub out comprises a steam outlet, and the steam outlet is configured to direct the steam flow toward the axis of the steam injector, wherein the steam injector comprises a mixing feature configured to induce rotation of the feedstock to facilitate mixing the steam flow with the feedstock, and wherein the steam flow interfaces with the feedstock in a radially inward direction from the steam outlet toward the axis of the steam injector.

9. The system of claim 8, wherein the steam injector is positioned directly upstream of a gasifier configured to gasify the feedstock.

10. The system of claim 8, wherein the mixing feature comprises projections in a substantially helical, screw-shaped pattern extending into the flow path of the feedstock.

11. The system of claim 10, wherein the projections comprise a substantially constant pitch along a length of the steam injector.

12. The system of claim 10, wherein the projections comprise a substantially constant projection height along a length of the steam injector.

* * * * *